United States Patent [19]

Kugler

[11] 4,376,690

[45] Mar. 15, 1983

[54] CATHODE FOR A CELL FOR FUSED SALT ELECTROLYSIS

[75] Inventor: Tibor Kugler, Thayngen, Switzerland

[73] Assignee: Swiss Aluminium Ltd., Chippis, Switzerland

[21] Appl. No.: 262,049

[22] Filed: May 11, 1981

[30] Foreign Application Priority Data

May 23, 1980 [CH] Switzerland ..... 4038/80

[51] Int. Cl.[3] ..... C25C 3/08; C25B 11/02; C25B 11/10

[52] U.S. Cl. ..... 204/243 R; 204/288; 204/289; 204/291; 204/292; 204/294; 204/67

[58] Field of Search ..... 204/67, 243 R–247, 204/288, 289, 291, 290 R, 294

[56] References Cited

U.S. PATENT DOCUMENTS 4,071,420 1/1978 Foster, Jr. et al. ..... 204/67

4,177,128 12/1979 Rahn ..... 204/243 R 4,231,853 11/1980 Rahn ..... 204/243 R 4,243,502 1/1981 Kugler ..... 204/294 X

*Primary Examiner*—Donald R. Valentine

*Attorney, Agent, or Firm*—Bachman and LaPointe

[57] ABSTRACT

A solid cathode in a fused salt electrolytic cell for the production of aluminum is made up of individually exchangeable elements (10). These cathode elements are made up of two parts which are rigidly joined together and which are resistant to thermal shock. The upper part (12) which projects from the molten electrolyte (30) into the precipitated aluminum (26), or the coating on this part (12), is made of a material which, at working temperature, is a good electrical conductor, is chemically resistant and is wet by aluminum. The lower part (14,16), which is exclusively in the liquid aluminum (26), or the coating on this part (14,16) is on the other hand made of an insulating material which can withstand molten aluminum.

30 Claims, 5 Drawing Figures

CATHODE FOR A CELL FOR FUSED SALT ELECTROLYSIS

BACKGROUND OF THE INVENTION

The invention relates to a cathode of individually exchangeable elements for a cell for fused salt electrolysis, in particular for the production of aluminum.

The production of aluminum from aluminum oxide by electrolysis is such that the latter is dissolved in a fluoride melt made up for the greater part of cryolite. The cathodic aluminum which separates out during the process collects under the fluoride melt on the carbon floor of the cell, the surface of the liquid aluminum itself forming the actual cathode. Anodes, which in conventional processes are made of amorphous carbon, are secured to overhead anode beams and dip into the melt from above. At the carbon anodes, as a result of the electrolytic decomposition of the aluminum oxide, oxygen is formed and combines with the carbon of the anodes to form $CO_2$ and CO. The electrolytic process takes place in general at a temperature of about 940°-970° C. In the course of this process the electrolyte is depleted of aluminum oxide. At a lower concentration of about 1-2 wt.% aluminum oxide in the electrolyte the anode effect occurs, whereby an increase in voltage from e.g. 4-4.5 V to 30 V and higher occurs. Then at the latest the crust of solidified electrolyte must be broken open and the aluminum oxide concentration increased by the addition of fresh aluminum oxide (alumina).

In the fused salt electrolytic production of aluminum the use of cathodes which are wet by aluminum is well known. Also suggested for cathodes for state of the art electrolytic cells producing aluminum are cathodes made of titanium diboride, titanium carbide, pyrolytic graphite, boron carbide and other substances including mixtures of these substances which can be sintered together.

Compared with conventional electrolytic cells with an interpolar distance of ca. 6-6.5 cm, decisive advantages are offered by cathodes which can be wet with aluminum and are not soluble in aluminum or are only slightly soluble in aluminum. The cathodic precipitated aluminum flows on the cathode surface facing the active anode surface, even when the layer of deposited aluminum is very thin. It is possible, therefore, to conduct the precipitated, liquid aluminum out of the gap between the anode and cathode and to lead it to a sump away from this gap.

As a result of the thin aluminum layer on the cathode surface, non-uniformity in the thickness of the aluminum layer, due to electromagnetic and convection forces and well known from conventional electrolysis, does not occur. This means that the interpolar distance can be reduced without penalty in current efficiency i.e. as a result a much smaller energy consumption per unit metal produced is achieved.

Suggested in U.S. Pat. No. 3,400,061 is an electrolytic cell in which wettable cathodes are secured to the carbon floor of the cell. The cathode plates are slightly inclined to the horizontal, towards the center of the cell. The size of the gap between the anode and cathode, i.e. the interpolar distance, is much smaller than in conventional cells. This has the result, however, that it is more difficult for electrolyte to circulate between anode and cathode. As the aluminum precipitates out, the cryolite becomes strongly depleted in alumina which makes the cell susceptible to the anode effect. Only a small part of the cell floor area is available for collecting the liquid metal. Therefore, in order that the intervals between the tapping of the cell do not become uneconomically short, the sump must be made deep which again calls for extra insulation of the cell floor.

It should also be noted that the connection between the carbon floor and the wettable cathode plates requires properties of the adhesive mass which are difficult to achieve. This adhesive mass also increases the electrical resistance in the floor of the cell. As with conventional electrolytic cells the floor is made of electrically conductive, i.e. poor thermally insulating, carbonaceous material.

Wettable cathodes are also employed in the process according to the German patent application DE-OS No. 26 56 579. In that case the circulation of the cryolite melt is improved by having the cathode elements anchored in the electrically conductive cell floor and the region below the anodes projecting out of the aluminum sump which covers the rest of the cell floor area. The cathode elements in that case are pipes which are closed at the bottom, are full of aluminum, and are made of material which is wet by aluminum.

Above the aluminum sump i.e. between the pipes, gaps between the cathode elements make circulation of electrolyte easier. The height of these gaps or pipes is chosen such that there is no significant current flow between the anodes and the aluminum sump. The means of current supply to the cathode elements in the above mentioned example of the German patent application suffer from the disadvantage of having the current flowing through the carbon floor. The streaming of the electrolyte is a whirling action around the cathode elements without any preferential direction. This means that the alumina concentration pattern will not be optimal.

An extension to the above German patent application can be found in U.S. Pat. No. 4,177,128. The pipes, which are by choice of electrically conductive or non-conductive material, are provided with an exactly fitting lid made of electrically conductive material. This lid is connected via a downwards directed extension to the liquid aluminum in the pipe. According to this version, however, more titanium boride is used in the electrically conductive pipes than in the above mentioned German patent application; electrically insulating pipes are not adequately resistant towards the molten cryolite. Also sludge is formed in non-hermetically sealed pipes. The sludge is difficult to re-dissolve and is practically impossible to remove.

A basic disadvantage of all the versions with wettable cathodes discussed up to now is that these cathodes are all permanently anchored in the floor of the cell. For economic reasons, therefore, the material chosen for the wettable cathodes must be such that its service life is at least as long as or greater than the operational life of the cell lining. The use of a cheaper material with a shorter service life or a simpler method of manufacture would mean that the failure of only a small proportion of the cathode elements, for example because of mistakes in production or operation, would result in the whole cell being put out of service. The carbon floor with the cast-in cathode conductor bars is, in general, extremely sensitive to flaws introduced during its preparation.

The applicant has suggested therefore in U.S. Pat. No. 4,243,502 for a molten salt electrolytic cell, in particular such a cell for producing aluminum, a wettable cathode which comprises individually exchangeable elements each with at least one means of current supply. This type of easily exchangeable cathode element eliminates the most serious of the above mentioned disadvantages however, some of the inconveniences still remain. The electrically conductive, wettable elements are made of relatively expensive material which is difficult to shape. There are therefore limits to the size and geometric form of the elements.

It is therefore an object of the present invention to develop a cathode of individually exchangeable elements for a molten salt electrolytic cell for producing aluminum which, in particular in terms of shape and shaping, can be made more economically.

SUMMARY OF THE INVENTION

This object is achieved by way of the invention in that the cathode elements are made of two parts which are rigidly joined together by mechanical means and are resistant to thermal shock. One upper part projects from the molten electrolyte into the precipitated aluminum and a lower part is situated exclusively in the precipitated aluminum. Both parts are made of different materials, whereby the upper part or its coating is made of a material which, at the working temperature, is a good electrical conductor, is chemically resistant and is wet by aluminum, and the lower part or its coating is made of an insulating material which is resistant towards liquid aluminum.

BRIEF DESCRIPTION OF THE DRAWINGS

The invention is explained in greater detail in the following description of exemplified embodiments with the help of the schematic drawings viz.

DETAILED DESCRIPTION

Figure 1:
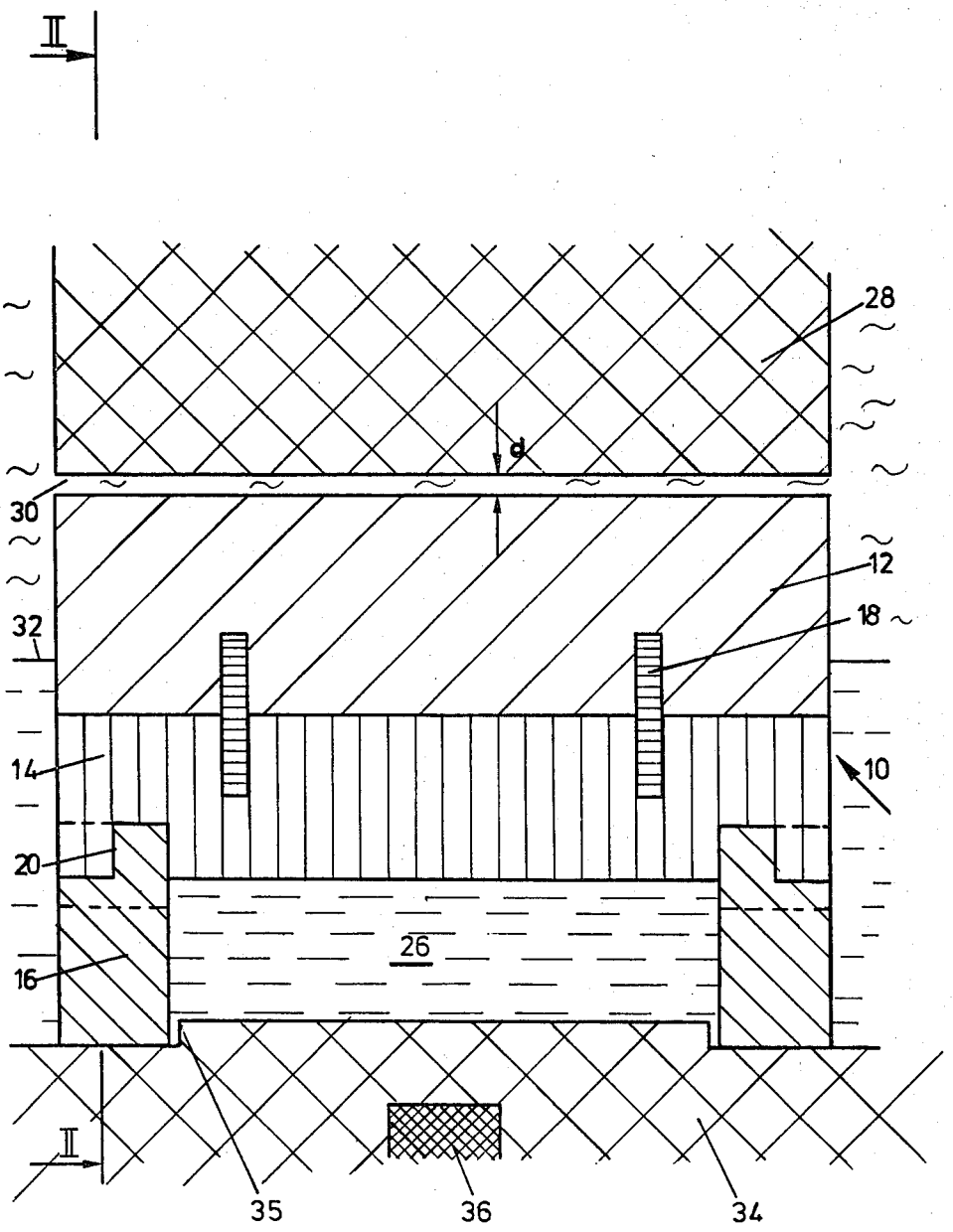
FIG. 1: A partial, vertical section through the active region of an electrolytic cell in the longitudinal direction through cathode plates which are wet by aluminum.

The upper parts of the elements are made of material described in the relevant literature for wettable cathode plates and satisfying the requirements for such material. Examples of this are titanium diboride, titanium carbide, titanium nitride, zirconium diboride, zirconium carbide, zirconium nitride and mixtures of two or more of these materials, which if desired can contain a small amount of boron nitride mixed in as well.

The electrically conductive, preferably plate shaped upper parts of the elements do indeed project into the liquid aluminum but do not touch the carbon floor of the cell.

The lower parts of the elements on the other hand need not be wettable by aluminum and need not be electrically conductive. They need only be compatible with molten aluminum, have sufficient mechanical strength and a high resistance to thermal shock. Materials which satisfy these requirements adequately are much more favorably priced than those employed for the upper parts or the coatings on the upper parts which have to be wettable by aluminum and electrically conductive.

Furthermore, the shaped parts of insulating material used for the lower part of the elements are much easier to manufacture. This fact, together with the lower cost of manufacturing these materials, results in the mass production of the lower parts being 10 to 20 times cheaper than that for the upper parts. As an example of such insulating materials which never come into contact with the molten electrolyte one can mention highly sintered aluminum oxide, ceramics containing aluminum oxide, silicon carbide or silicon carbide bonded with silicon nitride. These materials have a higher specific weight than aluminum and are resistant to erosion, which is important with regard to the sludge circulating in the aluminum.

Both the lower and the upper part of the cathode element, instead of being a homogeneous solid body, can be made of a core of less expensive mechanically stable material such as e.g. steel, titanium or graphite which is coated by a known process with at least one of the suitable materials. In the case that graphite is used as the core material, the composite body can be made with the aid of a sintering process.

The cathode elements are preferably made up of a plurality of sub-elements. The electrically conductive sub-elements forming the upper part are then usefully made in the simplest possible geometric shape e.g. 1–2 cm thick, vertically mounted plates with the distance between the plates being greater than their thickness. The easily formable and workable sub-elements of insulating material making up the lower part provide a support or supporting construction for the upper sub-elements.

Using a combination of sub-elements it is possible to unite simple, electrically conductive hard metal parts, without mechanical or any other form of shaping after sintering, i.e. with possibly large deviations from the intended dimensions. It is also possible to provide an assembly which is stable in shape and permits stressing by transporting equipment during installation or removal from the cell without destroying the relatively sensitive upper parts as a result of impact, bending stresses etc. Mechanical effects which arise during the operation of the cell are less dangerous.

The dimensions and therefore the weight of the electrically conductive parts, which incur by far the largest financial outlay, are much smaller than in all known cells with solid cathodes.

The dimensions of the horizontal surface of cathode elements are, usefully, selected in such a way that a whole number multiple, between 1 and 7 times the horizontal surface dimensions, corresponds to that of the above anode. Preferred however are the horizontal geometric dimensions of a cathode element and the corresponding anode of the same magnitude.

On installing or changing a cathode element the above lying anode can be removed briefly. This is of great advantage for the following reasons:

(a) Defective cathode elements can be replaced without interrupting operation of the cell.

(b) Cathode elements of a different design can be installed in cells, the running or efficiency of which is not satisfactory.

As already described in the aforesaid U.S. Pat. No. 4,243,502, the way the current is led from the source to the cathode surface is of crucial importance for the running of the cell. The electrolyte between anode and cathode element is subjected to the effects of flow of electrolyte and the magnetic field of a magneto-hydrodynamic pumping action.

Figure 2:
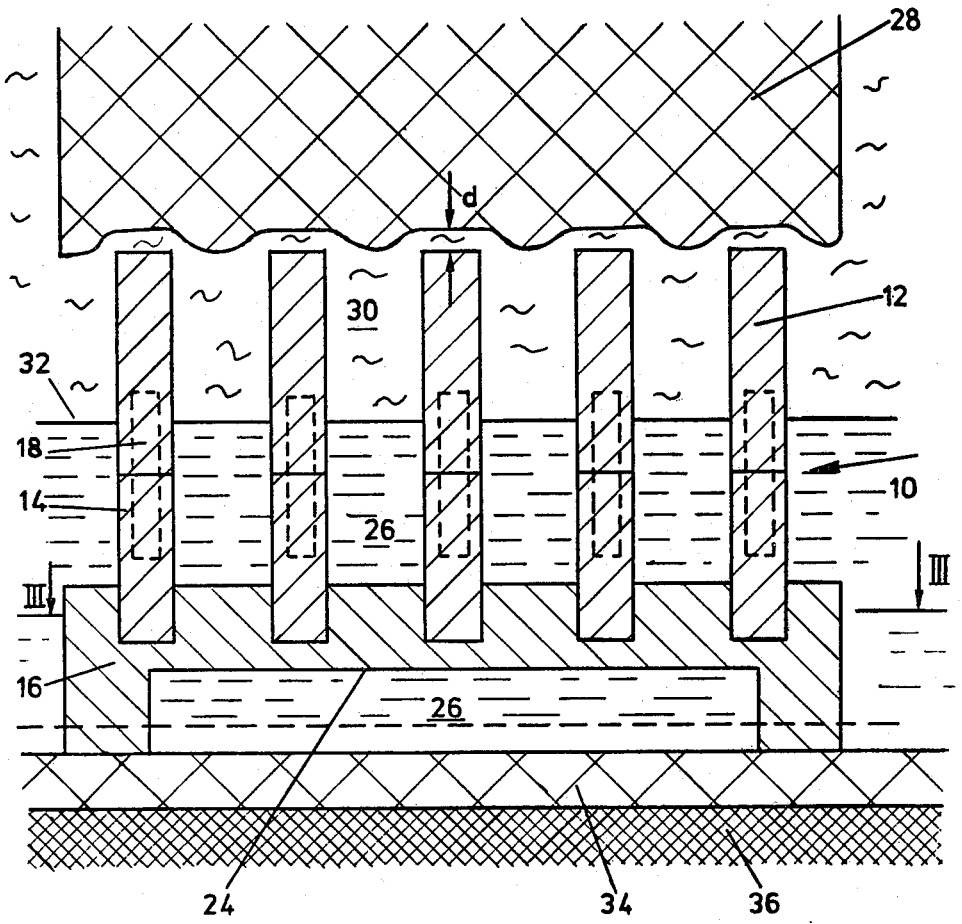
FIG. 2: A vertical section at II—II in FIG. 1 in the transverse direction through the cathode plates.
Figure 3:
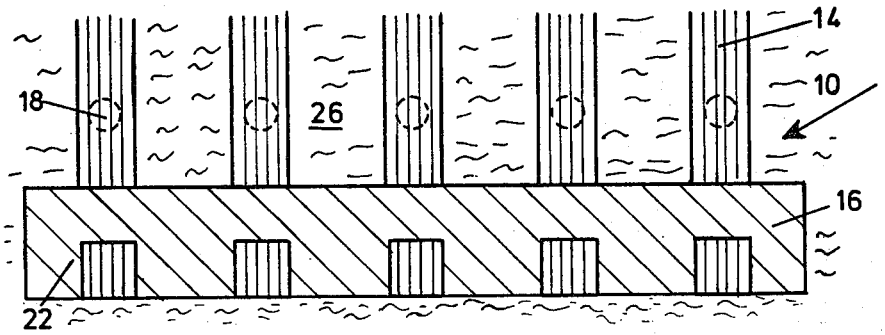
FIG. 3: A horizontal section along III—III in FIG. 2.

Referring specifically to the drawings, a cathode element 10 is shown in FIGS. 1-3. Element 10 has an upper part made up of plates 12 which are electrically conductive and can be wet by aluminum and a lower part made up of shaped plates 14,16 which are compatible with aluminum. In the present example the wettable cathode plates 12 are joined mechanically to insulating plates 14 of the same dimensions by means of round bolts 18 such that the assembly is mechanically stable. The bolts 18 are preferably made out of a more readily workable and less expensive insulating material and do not come into contact with the molten electrolyte.

The plates 14 made of insulating material feature on their underside recesses 20 which in turn engage by virtue of their shape in recesses 22 into which supporting plates 16 of insulating material likewise fit.

The result is that, using simple means, a mechanically stable cathode element is formed and a group of cathode plates 12 which can be wet by aluminum is fitted together to form a unit using a supporting structure of much cheaper material. The mass of this cathode element 10 is large enough that it is not displaced or carried away by currents in the bath.

If a further increase in mechanical stability is desired, intermediate pieces can be employed e.g. in the form of wedges and/or cement which can withstand liquid aluminum. The elements can afterwards also adjust adequately to the thermal expansion experienced there.

The supporting plates 16 feature on their underside recesses 24 which are provided basically for three reasons:

(a) The liquid aluminum 26 can circulate freely; this prevents bottom sludge forming.

(b) Material costs are saved.

(c) The cathode element 10 can be more easily inserted or removed from the cell.

The electrically conductive cathode plates 12 are at a distance d, the interpolar distance, from the carbon anode 28 which is being consumed. During the electrolytic process the electrolyte is consumed rapidly in a narrow gap between cathode plates and anodes. The cathode plates 12 are relatively narrow. For this reason the streaming of the electrolyte can quickly replenish the electrolyte depleted of aluminum oxide in the interpolar gap, even when the dimension d is much below the normal value of 6-6.5 cm. The precipitated metal forms an uninterrupted film on the wettable cathode plates 12 and flows down into the sump 26.

The surface 32 of the liquid aluminum 26 must always lie in the range of the wettable cathode plates 12 and the level of the metal must never fall to the region of the insulating plates 14,16, especially when tapping the cell. This would cause a break in current, corrosive attack and destruction of the insulating plate.

The electrolyzing direct current flows from the anodes 28 through the electrolyte 30 in the interpolar gap to the cathode plates 12. The current then enters the liquid aluminum 26 and finally flows via the carbon floor 34 into the iron cathode conductor bars 36.

From FIG. 2 it is clear that the working surface of the anode 28 takes on the shape of the cathode. For this reason plates which extend over the whole width of the anode working surface are employed by way of preference in the process according to the invention.

In principle use could also be made of wettable cathodes which, for example, according to the state of the art feature known tubes. This would however cause corresponding recesses to be formed in the working face of the anode. These would in turn cause gas pockets during the electrolytic process, which would reduce current efficiency.

In the carbon floor 34 of the electrolytic cell alignment grooves 35 can be provided. These would make it impossible for the cathode elements 10 to slip sideways.

Figure 4:
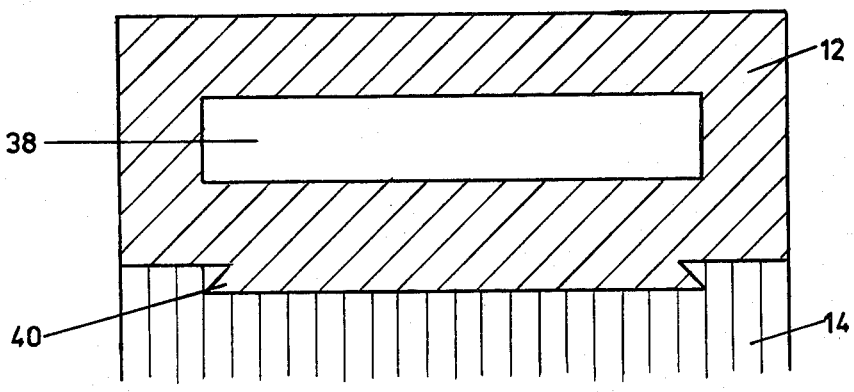
FIG. 4: A vertical, longitudinal section through one version of cathode plates.

FIG. 4 shows one version of a cathode plate 12. The provision of a window 38 permits the saving of material and improves the streaming action of the electrolyte. Plate 12 features on its underside a dovetail 40 which can be introduced into an appropriately shaped recess in the support plate 14. The supporting construction of insulating material is then designed so that the plates can not be displaced sideways.

Figure 5:
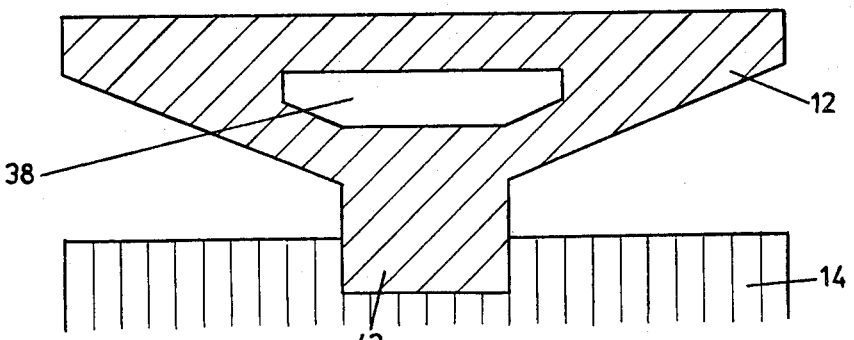
FIG. 5: A vertical, longitudinal section through a further version of cathode plates.

A further version of wettable cathode plates 12 is shown in FIG. 5. The provision of a window 38 and the inclined underside are to save wettable cathode material and to optimize the conditions for flow of electrolyte in the bath. The cathode plate 12 is secured in a supporting plate 14 by means of a projection 42 which is directed downwards at the center.

The term "insulating material" used in the description embraces also materials which are poor electrical conductors. On the other hand materials which are good electrical conductors are never used for the supporting construction, because:

(a) They are more expensive and more difficult to manufacture, and (b) contact effects and erosion would occur at the points of transition to the highly conductive cathode plates 12.

A supporting construction 14,16 itself is not an object of the invention; any suitable version employed in other areas of engineering can be used for this.

The cathode elements according to the invention can also be installed to refit existing cells in that the unit, designed to suit the anode dimensions and the metal level, is simply placed on the carbon floor. This enables the interpolar distance to be reduced with little extra cost, and consequently the current yield to be increased. It should be noted in particular that the refitting can be carried out without putting the cell out of service and that the possible, later changing of defective cathode elements presents no problem.

What is claimed is:

1. A cathode of individually exchangeable elements for a fused salt electrolytic cell for the production of molten aluminum from a molten electrolyte which comprises two parts made of different materials rigidly joined together with an upper part adapted to project from the molten electrolyte into the precipitated aluminum and a lower part, wherein the level of precipitated aluminum is adapted to be above said lower part, wherein at least the surface of the upper part is made of a material which at the working temperature is a good electrical conductor, is chemically resistant and is wet by aluminum, and at least the surface of the lower part is made of an insulating material which is resistant to liquid aluminum.

2. A cathode according to claim 1 wherein said two parts are rigidly joined together by mechanical means and are resistant to thermal shock.

3. A cathode according to claim 1 wherein said cathode has a core made of a material selected from the group consisting of steel, titanium and graphite.

4. A cathode according to claim 1 wherein at least the surface of the upper part is made of a material selected from the group consisting of titanium diboride, titanium carbide, titanium nitride, zirconium diboride, zirconium carbide, zirconium nitride and mixtures thereof.

5. A cathode according to claim 1 wherein at least the surface of the lower part is made of a material selected from the group consisting of highly sintered aluminum oxide, ceramics containing aluminum oxide, silicon carbide and silicon carbide bonded with silicon nitride.

6. A cathode according to claim 1 wherein said lower part includes at least one recess on the underside thereof.

7. A cathode according to claim 1 wherein said cathode is independent of any attachment means within said electrolytic cell such that said cathode may be used to refit existing electrolytic cells and to replace defective cathodes without putting said electrolytic cell out of service.

8. A cathode according to claim 1 wherein said cathode is provided on its lower part with alignment means which fit corresponding alignment means within said electrolytic cell.

9. An electrolytic cell for the electrolysis of a molten electrolyte having anode and cathode elements, in particular for the production of molten aluminum, said cell having individually exchangeable cathode elements comprising two parts made of different materials rigidly joined together with an upper part adapted to project from the molten electrolyte into the precipitated aluminum and a lower part, wherein the level of precipitated aluminum is adapted to be above said lower part, wherein at least the surface of the upper part is made of a material which at the working temperature is a good electrical conductor, is chemically resistant and is wet by aluminum, and at least the surface of the lower part is made of an insulating material which is resistant to liquid aluminum.

10. A cell according to claim 9 wherein said two parts are rigidly joined together by mechanical means and are resistant to thermal shock.

11. A cell according to claim 9 wherein said cathode has a horizontal surface dimension, and wherein said anode has an overlying horizontal surface dimension.

12. A cell according to claim 11 wherein a whole number multiple between 1 and 7 of the horizontal surface dimensions of the cathode corresponds to the horizontal surface dimensions of the anode.

13. A cell according to claim 9 wherein said cathode has a core made of a material selected from the group consisting of steel, titanium and graphite.

14. A cell according to claim 9 wherein at least the surface of the upper part is made of a material selected from the group consisting of titanium diboride, titanium carbide, titanium nitride, zirconium diboride, zirconium carbide, zirconium nitride and mixtures thereof.

15. A cell according to claim 9 wherein at least the surface of the lower part is made of a material selected from the group consisting of highly sintered aluminum oxide, ceramics containing aluminum oxide, silicon carbide and silicon carbide bonded with silicon nitride.

16. A cell according to claim 9 wherein said cathode is independent of any attachment means within said electrolytic cell such that said cathode may be used to refit existing electrolytic cells and to replace defective cathodes without putting said electrolytic cell out of service.

17. A cell according to claim 9 wherein said cathode is provided on its lower part with alignment means which fit corresponding alignment means within said electrolytic cell.

18. A cathode of individually exchangeable elements for a fused salt electrolytic cell for the production of molten aluminum from a molten electrolyte which comprises two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein said upper part comprises vertical plates which have a horizontal surface.

19. A cathode according to claim 18 wherein the distance between said plates is greater than their thickness.

20. A cathode of individually exchangeable elements for a fused salt electrolytic cell for the production of molten aluminum from a molten electrolyte which comprises two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein said cathode is stabilized by the inclusion of intermediate pieces which can withstand liquid aluminum.

21. A cathode of individually exchangeable elements for a fused salt electrolytic cell for the production of molten aluminum from a molten electrolyte which comprises two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein said cathode is stabilized by the inclusion of cement which can withstand liquid aluminum.

22. A cathode of individually exchangeable elements for a fused salt electrolytic cell for the production of molten aluminum from a molten electrolyte which comprises two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein at least one window is provided in said cathode.

23. A cathode of individually exchangeable elements for a fused salt electrolytic cell for the production of molten aluminum from a molten electrolyte which comprises two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein only said upper part has a core made of a material selected from the group consisting of steel, titanium and graphite.

24. A cathode of individually exchangeable elements for a fused salt electrolytic cell for the production of molten aluminum from a molten electrolyte which comprises two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein only said lower part has a core made of a material selected from the group consisting of steel, titanium and graphite.

25. A cathode of individually exchangeable elements for a fused salt electrolytic cell for the production of molten aluminum from a molten electrolyte which comprises two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein at least the surface of said upper part is made of a material selected from the group consisting of titanium diboride, titanium carbide, titanium nitride, zirconium diboride, zirconium carbide, zirconium nitride and mixtures thereof and wherein at least the surface of the material of the upper part contains an addition of a small amount of boron nitride.

26. A cathode of individually exchangeable elements for a fused salt electrolytic cell for the production of molten aluminum from a molten electrolyte which comprises two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein said upper part includes an inclined underside.

27. An electrolytic cell for the electrolysis of a molten electrolyte having anode and cathode elements, in particular for the production of molten aluminum, said cell having individually exchangeable cathode elements comprising two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein said upper part comprises plates which are arranged vertically in the cell and which have a horizontal surface.

28. A cell according to claim 27 wherein said horizontal surface extends over the entire region of the working surface of the anode.

29. An electrolytic cell for the electrolysis of a molten electrolyte having anode and cathode elements, in particular for the production of molten aluminum, said cell having individually exchangeable cathode elements comprising two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein at least one window is provided in said cathode.

30. An electrolytic cell for the electrolysis of a molten electrolyte having anode and cathode elements, in particular for the production of molten aluminum, said cell having individually exchangeable cathode elements comprising two parts made of different materials rigidly joined together with an upper part projecting from the molten electrolyte into the precipitated aluminum and a lower part situated exclusively in the molten aluminum, wherein at least the surface of the upper part is made of a material which at the working temperature is a good electrical conductor, is chemically resistant and is wet by aluminum, and at least the surface of the lower part is made of an insulating material which is resistant to liquid aluminum, wherein at least the surface of the upper part is made of a material selected from the group consisting of titanium diboride, titanium carbide, titanium nitride, zirconium diboride, zirconium carbide, zirconium nitride and mixtures thereof and wherein at least the surface of the material of the upper part contains an addition of a small amount of boron nitride.

* * * * *